United States Patent [19]

Reithner et al.

[11] 4,332,289

[45] Jun. 1, 1982

[54] STARTER BAR HEAD TO BE USED FOR CASTING METAL IN A CONTINUOUS CASTING MOULD OF A CONTINUOUS CASTING PLANT

[75] Inventors: Gerhard Reithner; Peter Wagner, both of Linz; Franz Kagerhuber, Hörsching, all of Austria

[73] Assignee: Voest-Alpine Aktiengesellschaft, Linz, Austria

[21] Appl. No.: 182,765

[22] Filed: Aug. 29, 1980

[30] Foreign Application Priority Data

Oct. 8, 1979 [AT] Austria ..... 6546/79

[51] Int. Cl.[3] ..... B22D 11/08

[52] U.S. Cl. ..... 164/446; 164/426

[58] Field of Search ..... 164/445, 446, 425, 426

[56] References Cited

U.S. PATENT DOCUMENTS

| | | | |
|---|---|---|---|
| 3,593,792 | 7/1971 | Hess et al. | 164/446 |
| 3,602,290 | 8/1971 | Schmidt et al. | 164/446 |
| 3,627,017 | 12/1971 | Knell et al. | 164/426 X |
| 3,717,198 | 2/1973 | Marti et al. | 164/445 |
| 3,948,310 | 4/1976 | Deschapelles | 164/425 |

FOREIGN PATENT DOCUMENTS

| | | | |
|---|---|---|---|
| 1558324 | 3/1970 | Fed. Rep. of Germany . | |
| 2832712 | 2/1979 | Fed. Rep. of Germany . | |
| 1470567 | 1/1967 | France . | |
| 45-10321 | 4/1970 | Japan | 164/426 |
| 562375 | 8/1977 | U.S.S.R. | 164/445 |

*Primary Examiner*—R. L. Spruill
*Assistant Examiner*—J. Reed Batten, Jr.
*Attorney, Agent, or Firm*—Brumbaugh, Graves, Donohue & Raymond

[57] ABSTRACT

A starter bar head for a continuous casting plant includes side faces that are directed to, and sealed relative to, the walls of a continuous casting mould, a front face closing the continuous casting mould, and at least one anchoring recess for the hot strand. The anchoring recess departs from a side face of the starter bar head, at least partly penetrates the front face of the starter bar head and is to be filled up by the metal to be cast. It is designed to be widened from the front face to a bottom face of the anchoring recess and includes at least two side walls arranged symmetrically to the longitudinal axis of the starter bar head and directed to the bottom face. The side walls of the anchoring recess pass over into a further recess whose surfaces that border at the mould side walls to be sealed off are directed upwardly, i.e. to the front face of the starter bar head. For making sealing off simpler, reducing the risk of a breakthrough during starting and ensuring a simpler handling of the sealing the further recess passes over into the side face of the starter bar head from which the anchoring recess departs, with a surface that encloses an approximately right angle with this side face.

3 Claims, 3 Drawing Figures

STARTER BAR HEAD TO BE USED FOR CASTING METAL IN A CONTINUOUS CASTING MOULD OF A CONTINUOUS CASTING PLANT

The invention relates to a starter bar head for a continuous casting plant, in particular for a steel-slab continuous casting plant, comprising side faces that are directed to, and sealed relative to, the walls of a continuous casting mould, a front face closing the continuous casting mould, and at least one anchoring recess for the hot strand, departing from a side face of the starter bar head, at least partly penetrating the front face of the starter bar head and to be filled up by the metal to be cast, which anchoring recess(es) is (are) designed to be widened from the front face to a bottom face of the anchoring recess(es) and include(s) at least two side walls arranged symmetrically to the longitudinal axis of the starter bar head and directed to the bottom face, wherein the side walls of the anchoring recess(es) pass over into a further recess whose surfaces bordering at the mould side walls to be sealed off are directed upwardly, i.e. to the front face of the starter bar head.

Starter bar heads having dovetail-shaped grooves or tongues are known for instance from German Pat. No. 674,136, U.S. Pat. No. 2,176,990, British Pat. No. 763,970, French Pat. No. 1,470,567. The separation of these known starter bar heads from the hot strand is effected either by a lateral displacement of the starter bar in order that the dovetail-shaped groove (or tongue) slides down from the counter piece formed on the hot strand, or by opening the tong cheeks (French Pat. No. 1,470,567). In order to prevent a damage of the mould, the starter bar heads, in their cross sections, are designed to be slightly smaller than the cross section of the mould, so that a peripheral air gap of a few millimeters, for instance 5 mm, is present between the mould walls and the side faces of the starter bar head to be sealed off. In order to prevent molten metal from penetrating into this air gap, the gap is sealed by means of sealing cords, preferably paper cords. These cords are inserted along the limitation edges of the front face and the anchoring recess extending at the mould side walls and are pressed into the gap manually by means of stuffing tools. This may lead to difficulties if the starter bar head—as well as the initially-cited starter bar heads—show undercuts which are not accessible from above. The sealing cord has to be pressed into these undercuts from aside, which is difficult and cumbersome, since the front face of the starter bar head usually is about half a meter below the casting platform. Following the insertion of the sealing cord, cooling scrap, in particular in the form of short-chip turning chips, is filled into the mould, which cooling scrap has the task of withdrawing so much heat from the metal flowing into the mould at the onset of casting, that firstly it will not weld together with the starter bar head and secondly it will not come into immediate contact with the sealing cord. If the starter bar head has a side edge that is not visible from the casting platform, i.e. from above, with the starter bar head introduced into the mould, the latter requirement is not met, since the turning chips will fall down from such an edge, on the bottom area of the anchoring recess and on the front face. Consequently, a burning-through of the sealing cord and a breakthrough of the strand during starting may occur. The sealing of the known starter bar heads therefore involves many problems, requires the utmost care and special measures, such as e.g. the utilization of heat-resistant sealing cords.

From German Offenlegungsschrift No. 28 32 712 a starter bar head of the initially-defined kind is known, with which the further recess is delimited by a plane, slanted surface extending over the total side face of the starter bar head. It is true that thereby it is prevented that the sealing cord has to be inserted into undercuts of the anchoring recess; yet, with this known embodiment of a starter bar head the slanted surface delimiting the recess has to enclose an acute angle with the side face of the starter bar head from which the anchoring recess departs. Thus, this slanted surface encloses an acute angle also with the corresponding mould side wall, whereby the insertion of the sealing cord and an exact sealing are still not possible in a satisfactory manner. Depending on the inclination of the slanted surfaces, the wedge-likely tapering gap formed by the slanted surface with the corresponding mould side wall constitutes a more or less great impediment with this known starter bar head.

The invention aims at avoiding these disadvantages and difficulties and has as its object to design a starter bar head of the initially-defined kind in a manner that a simply realizable sealing is possible, the danger of a breakthrough during starting being largely reduced. The accessibility to the gap between the starter bar head and the mould side walls receiving the sealing cord is to be considerably improved, wherein, however, the starter bar still can be separated from the hot strand in a simple manner and within a short span of time, despite a good anchorage in the starter bar.

This object is achieved according to the invention in that the further recess passes over into the side face of the starter bar head from which the anchoring recess departs, with a surface that encloses an approximately right angle with this side face. By the fact that one surface of the further recess is directed approximately at a right angle to the side face of the starter bar head from which the anchoring recess departs, a considerably better accessibility to the gap between the corresponding mould side wall and these side faces of the starter bar head is reached. The sealing cord can be attached more easily and a check for an appropriate attachment of the sealing cord is also more easily possible, the danger of a breakthrough during starting thus being considerably reduced.

According to a preferred embodiment, the further recess is pyramidally designed, the base of the pyramid being arranged on the front face and the vertex of the pyramid being arranged on the bottom face.

A further advantageous embodiment is characterized in that the further recess is designed to be prism-shaped.

The invention will now be explained in more detail with reference to the accompanying drawing, wherein.

Figure 1:
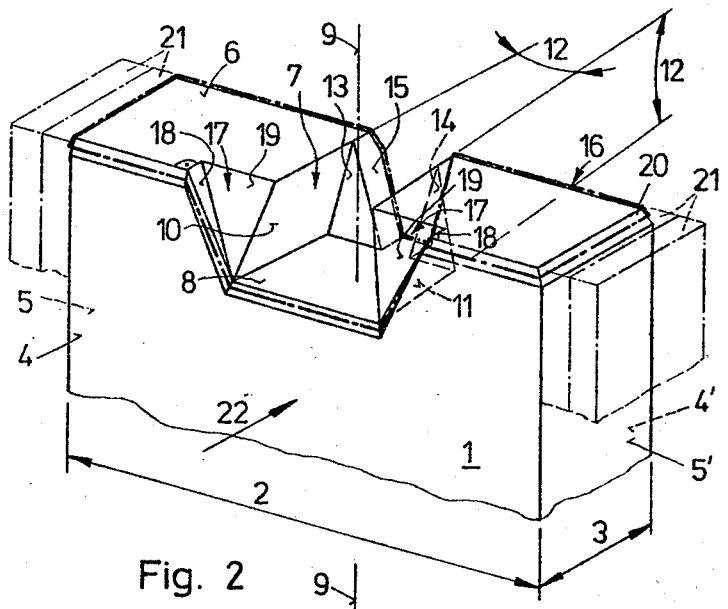
FIG. 1 illustrates a starter bar head according to a first embodiment in an oblique view.

A starter bar head 1, from which only the upper end section is illustrated, is articulately connected in a known manner, for instance by means of a hinge pin, with a flexible starter bar formed of link bodies. The width 2 and the thickness 3 of the starter bar head having a rectangular cross section each are smaller by 8 to 10 mm than the respective mould measurements.

The starter bar head comprises broad side faces 4, 4' and narrow side faces 5, 5', which are directed to the walls of the continuous casting mould and pass over into a front face 6 of the head on the upper end. According to FIG. 1 a dovetail-shaped groove 7 extends from a front broad-side face 4 transversely through the starter bar head 1, constituting an anchoring recess for the hot strand. This groove penetrates the front face 6 and is filled with molten metal when casting-on the hot strand. It is widened from the front face 6 as far as to the bottom face 8 and has two side walls 10, 11, which are arranged symmetrically to the longitudinal axis 9 of the starter bar head 1 and are directed to the bottom face 8.

The two side walls 10, 11 of the anchoring recess 7, arranged symmetrically to the longitudinal axis 9, together enclose a slight angle 12—measured in the front face plane—, preferably of about 3°, which angle approximately corresponds to the draught of a die. The side faces of the anchoring recess thereby diverge towards that broad side face 4 of the starter bar head 1 from which the anchoring recess 7 departs. Advantageously, the bottom face 8 encloses an equal angle 12 with the front face 6.

The anchoring recess 7 extends transversely through the whole starter bar head, i.e. it runs into the broad side face 4, wherein, however, the anchoring recess 7 is designed so as to taper towards the bottom face 8 by two triangular noses 13, 14, which are either inserted in the anchoring recess or are designed to be integral with the starter bar head. These triangular noses 13, 14 each comprise an end face 15 that is directed towards the front face 6 of the starter bar head 1, whereby a simple insertion of a sealing cord 16 (drawn in dot-and-dash lines) from above is possible. On the front broad-side wall 4 the groove 7 passes over into a further recess 17 which is pyramidally designed.

The side faces 18, 19 of this recess are directed upwardly, i.e. to the front face, so that the sealing cord 16, in this case, also can be easily inserted from above, the cooling scrap and the turning chips applied not falling down from the sealing cord 16 any longer. For an easier insertion of the sealing cord 16, the side faces 4, 4', 5, 5' of the starter bar head 1, which are directed to the side walls of the mould, are provided with chamfers 20 at the transition to the front face 6. The vertices of the pyramidal recesses 17 in this embodiment are located on the bottom face 8 of the anchoring recess, the bases are provided in the front face 6.

Those surfaces 18 of the further recesses 17 which pass over into the broad side face 4 of the starter bar head 1 enclose an approximately right angle with this broad side face so that there is sufficient space for manipulations and a check of the sealing cord 16. This starter bar head represented in FIG. 1 has the advantage that it is adaptable to different mould widths, and strand widths, by simply designed doublings 21, i.e. rectangular plates mountable to the narrow side faces 5, 5'. When providing such doublings which are illustrated in FIG. 1 in dot-and-dash lines, the sealing cord 16 is applied around the outermost doubling 21 each.

A further advantage of the starter bar head according to FIG. 1 is to be seen in the fact that the pyramid-shaped recesses 17 comprise but relatively small slanted faces 18, 19, which means that a slanted face that extends over the total width 2 of the starter bar head is avoided. For, such slanted faces have the disadvantage that they cannot easily be covered by cooling scrap, the danger of welding together thus being more likely than with horizontal surfaces.

For separating the hot strand from the starter bar, the starter bar head 1 is displaced parallel in the direction of the arrow 22, perpendicularly to the longitudinal axis 9 and perpendicularly to the broad side face 4 of the starter bar head. Due to the bottom face 8 being slightly slanted and the side walls 10, 11 of the anchoring recess 7 being arranged at an angle 12, a small force suffices for the separation of the starter bar head from the hot strand. This is also due to the fact that the hot strand shrinks, i.e. the part of the hot strand cast into the anchoring recess 7 decreases and therefore does not tend to get jammed within the anchoring recess 7.

Figure 2:
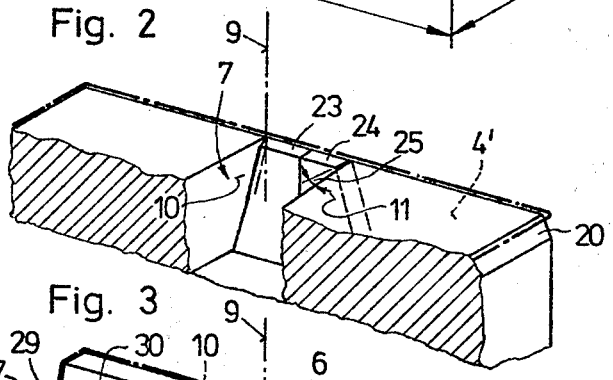
FIG. 2 represents a detail of a starter bar head corresponding to FIG. 1, according to a second variant.

In the embodiment illustrated in FIG. 2, the groove 7 is closed towards the rear broad-side face 4' of the starter bar head by two plates 23, 24 complementing each other to groove cross-section, which are insertable into the groove 7 and weldable together with the starter bar head 1. For an easier insertion of the plates 23, 24 the sides that are directed to the side walls 10, 11 of the groove enclose an acute angle 25 with the side walls 10, 11 of the groove 7. These plates 23, 24 may also be designed to be integral with the starter bar head 1.

Figure 3:
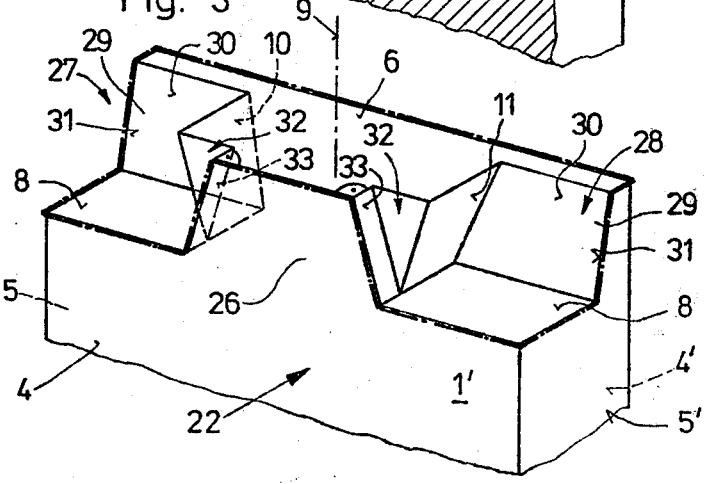
FIG. 3 illustrates a further embodiment of a starter bar head in a representation analogous to FIG. 1.

A further variant is illustrated in FIG. 3, in which, instead of the dovetail-shaped anchoring recess 7, a dovetail-shaped tongue 26 is provided, so that the anchoring recess in the starter bar head 1' is divided into two parts, each designed to border at a narrow-side wall. Both anchoring recesses 27, 28 are closed towards the rear broad side of this starter bar head by plate-like noses 29. The plate-like noses are provided with limitation surfaces 30 directed upwardly, i.e. towards the front face 6, so that the limitation edge 31 formed by this limitation surface 30 on the side wall is accessible from above. On the front broad-side wall 4 the anchoring recesses 27, 28 pass over into further prism-shaped recesses 32, wherein the limitation surfaces 33 of the further recesses 32 bordering at the broad side 4 are directed upwardly, i.e. towards the front face 6.

Also in this embodiment, the surface 33 of each prism-shaped recess 32 passing over into the broad side face 4 encloses a right angle with the broad side face 4, a good accessibility to the gap between the mould and the starter bar head thus also being provided. As can be seen from FIG. 3, also here the sealing cord 16 can be simply inserted from above and pressed in.

The symmetric arrangement of the side walls 10, 11 in all the embodiments described makes possible a centric force transmission between the hot strand and the starter bar, so that no transverse forces and moments will occur at the starter bar head 1, 1' or at the hot strand due to the retaining and tensile forces, respectively, which transverse forces and moments might lead to an increased strain on the strand guide, on the hot strand and on the starter bar.

The invention is not limited to the embodiments illustrated in the drawing, but can be modified in various aspects. Thus, it is for instance possible to provide several recesses in the starter bar head for particularly broad slabs, which recesses extend along the starter bar head transversely to the slab broad sides. The recesses need not be designed in a dovetail manner, but they may also have a hammer-head-shaped cross section.

Furthermore, it is possible to design a starter bar head in a divided manner, on fastening the two parts to each other in a tong-like manner, and to effect the separation of the starter bar from the hot strand by opening these tong parts.

The inclination of the surfaces 18, 33 of the further recesses 17, 32 bordering at the starter bar head walls to be sealed off may be chosen arbitrarily. It is only necessary that these surfaces 18, 33 enclose an angle with the front face 6 of the starter bar head 1, 1' which is smaller than 270° and an angle with the bottom face 8 of more than 90°. These surfaces need not be designed to be plane; they also may be curved.

All the examples show a starter bar head for a steel-slab continuous casting plant, yet the invention is not limited to this embodiment. A starter bar head to be used in a plant for billets, for instance, may be designed in an analogous manner.

What we claim is:

1. In a starter bar head to be used for casting metal in a continuous casting mould of a continuous casting plant, in particular a continuous casting plant for steel slabs, and of the type including side faces directed to and sealed relative to the walls of the continuous casting mould, a front face closing the continuous casting mould, at least one anchoring recess for the hot strand departing from one of said side faces, at least partly penetrating said front face of said starter bar head and to be filled up by the metal to be cast, which anchoring recess possesses a bottom face and is designed so as to widen from said front face to said bottom face and further has at least two side walls arranged symmetrically to the longitudinal axis of said starter bar head and directed to said bottom face, a further recess provided in said starter bar head, said two side walls of said at least one anchoring recess passing over into said further recess, and which further recess includes a surface bordering at the mould side walls to be sealed off and directed upwardly to said front face of said starter bar head, the improvement which is characterized in that said further recess passes over into the side face of said starter bar head from which said anchoring recess departs with a surface enclosing an approximately right angle with the respective side face.

2. A starter bar head as set forth in claim 1, wherein said further recess is designed as a pyramid including a base and a vertex, said base of said pyramid being arranged on said front face and said vertex of said pyramid being arranged on said bottom face.

3. A starter bar head as set forth in claim 1, wherein said further recess is prism-shaped.

* * * * *